US010020099B2

(12) United States Patent
Kato et al.

(10) Patent No.: US 10,020,099 B2
(45) Date of Patent: Jul. 10, 2018

(54) RARE EARTH BASED MAGNET

(71) Applicant: TDK CORPORATION, Tokyo (JP)

(72) Inventors: Eiji Kato, Tokyo (JP); Yoshinori Fujikawa, Tokyo (JP); Taeko Tsubokura, Tokyo (JP); Chikara Ishizaka, Tokyo (JP); Katsuo Sato, Ichikawa (JP)

(73) Assignee: TDK CORPORATION, Tokyo (JP)

( * ) Notice: Subject to any disclaimer, the term of this patent is extended or adjusted under 35 U.S.C. 154(b) by 938 days.

(21) Appl. No.: 14/332,666

(22) Filed: Jul. 16, 2014

(65) Prior Publication Data

US 2015/0310972 A1 Oct. 29, 2015

(30) Foreign Application Priority Data

Jul. 16, 2013 (JP) ..... 2013-147690
Dec. 20, 2013 (JP) ..... 2013-263372

(51) Int. Cl.
*H01F 1/057* (2006.01)
*C22C 38/00* (2006.01)
(Continued)

(52) U.S. Cl.
CPC ..... *H01F 1/0577* (2013.01); *C22C 38/002* (2013.01); *C22C 38/005* (2013.01); *H01F 1/0536* (2013.01); *H01F 1/086* (2013.01)

(58) Field of Classification Search
None
See application file for complete search history.

(56) References Cited

U.S. PATENT DOCUMENTS

2006/0165550 A1* 7/2006 Enokido ..... H01F 1/057 420/40
2006/0231165 A1* 10/2006 Kato ..... H01F 1/0577 148/302
(Continued)

FOREIGN PATENT DOCUMENTS

CN 104078176 A 10/2014
JP A-59-222564 12/1984
(Continued)

OTHER PUBLICATIONS

Jiang et al., "Effect of discrete distribution of powder size on magnetic properties of NdFeB," High Power Laser and article Beams, May 2012, vol. 24, No. 5., pp. 1173-1176.

*Primary Examiner* — Jessee R Roe
*Assistant Examiner* — Ngoclan T Mai
(74) *Attorney, Agent, or Firm* — Oliff PLC

(57) ABSTRACT

The present invention provides a rare earth based magnet that inhibits the high temperature demagnetization rate even when less or no heavy rare earth elements such as Dy, Tb and the like than before are used. The rare earth based magnet according to the present invention is a sintered magnet which includes $R_2T_{14}B$ crystal grains as main phase and grain boundary phases between the $R_2T_{14}B$ crystal grains. when evaluating the cross-sectional area distribution of the main phase crystal grains by histogram in any cross-section of the rare earth based magnet, the crystal grains with large particle size and the crystal grains with small particle size are controlled so that the cross-sectional area distribution becomes the one which respectively has at least one peak at two sides of the average value of the cross-sectional area.

5 Claims, 4 Drawing Sheets

(51) Int. Cl.
*H01F 1/053* (2006.01)
*H01F 1/08* (2006.01)

(56) References Cited

U.S. PATENT DOCUMENTS

| | | | | |
|---|---|---|---|---|
| 2010/0233016 | A1* | 9/2010 | Tsubokura | C22C 33/0278 420/83 |
| 2014/0290803 | A1 | 10/2014 | Kato et al. | |
| 2016/0042847 | A1* | 2/2016 | Nishiuchi | C22C 38/001 335/302 |

FOREIGN PATENT DOCUMENTS

| | | |
|---|---|---|
| JP | B2-7-78269 | 8/1995 |
| JP | 2000-188213 A | 7/2000 |
| JP | A-2002-327255 | 11/2002 |

* cited by examiner

RARE EARTH BASED MAGNET

The present invention relates to a rare earth based magnet, especially a rare earth based magnet obtained by controlling the microstructure of the R-T-B based sintered magnet.

BACKGROUND

The R-T-B based sintered magnet (R represents a rare earth element, T represents one or more elements of iron group elements containing Fe as an essential, and B represents boron), a representative of which is Nd—Fe—B based sintered magnet, is advantageous for miniaturization and high efficiency of the machines using it due to high saturation flux density, and thus can be used in the voice coil motor of the hard disk drive and the like. In recent years, the R-T-B based sintered magnet also has been applicable in various industrial motors, or driving motors of hybrid vehicles, or the like. From the viewpoint of energy conservation and the like, it is desirable that the R-T-B based sintered magnet can be further popularized in these fields. However, when applied in the hybrid vehicles and the like, the R-T-B based sintered magnet will be exposed to a relatively high temperature. Therefore, inhibition of the high temperature demagnetization caused by heat becomes important. For inhibition of the demagnetization under high temperature, a method for sufficiently improving coercivity of the R-T-B based sintered magnet at room temperature is well known as effective. In addition, the iron group elements in the present specification mean Fe, Co and Ni.

For example, as a method for improving a coercivity of the Nd—Fe—B based sintered magnet at room temperature, a method in which part of Nd of the compound $Nd_2Fe_{14}B$ as the main phase is replaced with heavy rare earth elements such as Dy, Tb and the like is well known. By replacing part of Nd with the heavy rare earth elements, the magnetic anisotropy of crystals is increased, and as a result, the coercivity of the Nd—Fe—B based sintered magnet at room temperature can be sufficiently improved. In addition to the replacement with heavy rare earth elements, addition of elements such as Cu and the like is also effective in improving coercivity at room temperature (Patent Document 1). By adding the element Cu, the phase such as Nd—Cu liquid phase can be formed by the element Cu at the grain boundary, and thus it is considered that the grain boundary become smooth and formation of reverse magnetic domains is inhibited.

Further, in the R-T-B based rare earth magnet, the ideal existing form of the $R_2T_{14}B$ as the main phase was pointed out at the initial stage of development. In Patent Document 2, it is described that 'as the existing form of the tetragonal compound, it is ideal that the fine particles having high anisotropy constant are isolated by the non-magnetic phase'.

PATENT DOCUMENTS

Patent Document 1: JP2002-327255A
Patent Document 2: JPH07-78269B

SUMMARY

In the case of using the R-T-B based sintered magnet at a high temperature of 100° C.~200° C., although the value of coercivity at room temperature is one of the effective indicators, no demagnetization or little demagnetization rate even when practically exposed to a high temperature environment is very important. Although coercivity of the composition in which part of R of the compound $R_2T_{14}B$ as the main phase is replaced by the heavy rare earth elements such as Tb or Dy is sharply improved at room temperature and this is a simple method for being a high coercivity, there are problems in terms of the resources since the heavy rare earth elements such as Dy, Tb and the like are limited in producing areas and yields. Accompanied with replacement, it is unavoidable for e.g., decrease of residual flux density due to antiferromagnetic coupling of Nd and Dy. Addition of the element Cu as described above and the like are also effective. Nonetheless, in order to enlarge the applicable field of the R-T-B based sintered magnet, it is desirable that the inhibition on the high temperature demagnetization (demagnetization due to exposure to a high temperature environment) is further enhanced.

Further, it is well known that the effect of the replacement with the heavy rare elements such as Dy, Tb and the like on improving coercivity at the room temperature is high, but the changes of magnetic anisotropic energy in temperature, which is the main factor of coercivity, is significantly large. Thus, it means that coercivity is sharply reduced at a high temperature environment of the rare earth based magnet. Therefore, the present inventors consider that it is also important to control the microstructure as shown below in order to obtain the rare earth based magnet with high temperature demagnetization inhibited. It is thought that the rare earth based magnet with excellent temperature stability is obtained if the improvement of coercivity can be realized by controlling the microstructure of the sintered magnet.

The coercivity of the rare earth based magnet, i.e., R-T-B based sintered magnet, depends on difficulty of nucleation of reverse magnetic domains. The coercivity becomes small if nucleation of reverse magnetic domains is easy, while the coercivity becomes large if nucleation is difficult. As a method of making nucleation of reverse magnetic domains difficult, it is considered that the main phase crystal grains with high anisotropy constant are isolated by non-magnetic phases. By means that the main phase crystal grains are magnetically isolated with non-magnetic grain boundary phases, magnetic influence from the adjacent main phase crystal grains can be inhibited, and thus high coercivity can be realized. As the other method of making nucleation of reverse magnetic domains difficult, it is also effective of reducing the particle size of the main phase crystal grains. Since the formation of reverse magnetic domains occurs at the outer surface of the crystal grains, the surface area of the main phase crystal grains can be decreased by reducing the particle size of the main phase crystal grains. Thus, the absolute number of nucleation of reverse magnetic domains can be reduced and probabilities of nucleation of reverse magnetic domains can be inhibited to be low.

Further, although a powder metallurgy method is used during manufacturing the rare earth based magnet in an industrial scale, it is very hard to produce rare earth based magnet with small particle size of main phase crystal grains by the powder metallurgy method. The reason is that the rare earth element R contained in the rare earth based magnet is easy to oxidize, and it is also necessary to reduce the particle size of raw alloy powders to obtain the magnet having small particle size of main phase crystal grains, so the oxidation is carried out in the manufacturing process, and as a result, deterioration of the magnetic properties is caused.

Here, the present invention is achieved by recognizing the above-mentioned situation. It is an object of the present invention to provide a rare earth based magnet with inhibition of the high temperature demagnetization is improved by controlling particle size distribution of the main phase crystal grains as the microstructure of the rare earth based magnet, specifically by controlling the cross-sectional area distribution of the main phase crystal grains in the cross-section of the sintered body.

The present inventors have earnestly made a study on the cross-sectional area distribution of the main phase crystal grains in the sintered body of the rare earth based magnet and its control method in order to dramatically improving inhibition of the high temperature demagnetization. As a result, the following invention is completed.

That is, the rare earth based magnet of the present invention is a sintered magnet which comprises $R_2T_{14}B$ crystal grains as main phase and grain boundary phases between the $R_2T_{14}B$ crystal grains. And it is characterized in that, when evaluating the cross-sectional area distribution of the main phase crystal grains by histogram (frequency distribution) in any cross-section of the rare earth based magnet, the cross-sectional area distribution is the one that respectively has at least one peak at two sides of the average value of the cross-sectional area. The method for making histogram in the present invention is described as follows.

In addition, in the rare earth based magnet of the present invention, the peak appeared at the side with the smaller value than the average value of the cross-sectional area is regarded as the first peak in the histogram of the cross-sectional area distribution of the main phase crystal grains. When multiple peaks appear at the side with the smaller value than the average value of the cross-sectional area, the peak with the highest frequency among these peaks is regarded as the first peak. Further, in the present specification, 'peak' means the part showing the convex upward shape between an interval showing the lowest frequency and the next interval showing the lowest frequency. And, 'peak' refers to the part, the width of which is over 4 intervals when the width is expressed based on the interval width of the histogram. In the rare earth based magnet according to the present invention, the width of the first peak is preferably 5.5 intervals or more when the width is expressed based on the interval width of the histogram. The calculation method of the width of peaks is described in detail below.

In addition, the rare earth based magnet according to the present invention is characterized in that, when the cross-sectional area distribution histogram of the main phase crystal grains is made into line graph by smoothing treatment, the line graph has a part with convex upward shape corresponding to the first peak in the cross-sectional area distribution histogram, and a protrusion corresponding to the peak formed at the side with larger value than the average value of cross-sectional area in the cross-sectional area distribution histogram, is contained at the shoulder of the side with larger cross-sectional area of the part becoming convex upward shape. If such protrusion is formed, the structure with big crystal grains surrounded by small ones is obtained and the decrease of high temperature demagnetization rate is achieved. Furthermore, the method of smoothing treatment in the present invention is described below. Here, the peak formed at the side larger than the average value of the cross-sectional area during evaluating whether there is a protrusion refers to the one closest to the average value of the cross-sectional area at the side with larger value than the average value in the histogram showing the cross-sectional area distribution. The 'protrusion' in the present specification refers to the part in which inclination of the line become negative, then positive, and then negative again in the line graph. In the line graph, in the case of inclination of the line become negative, then zero, and then negative again, it is called as flat instead of protrusion.

In the rare earth based magnet according to the present invention, crystal grains with large particle size (large curvature radius) and those with small particle size (curvature radius small) are adjacent and thus the proportion of the grain boundary formed between the main phase crystal grains can be increased by setting the cross-sectional distribution (i.e., particle size distribution) of the main phase crystal grains in the sintered body as the above mentioned. As a result, magnetic decoupling effect can be brought out for the crystal grains with large particle size. And with respect to the crystal grains with small particle size, probabilities of nucleation of reverse magnetic domains can be decreased by reducing the surface area.

The grain boundary in the sintered body of the rare earth based magnet according to the present invention contains the elements R-T-M. By adding the rare earth element R, the iron group element T, and further additive element M forming ternary eutectic point together with the R and T as the constituent element of the main phase crystal grains, the crystal grains with small particle size can be distributed in the sintered body through the reaction between outer edges of main phase crystal grains and the grain boundary phase during the manufacturing process with the powder metallurgic method even when the raw alloy powders having a relatively large particle size. The decrease of the particle size caused by the reaction at the outer edges of the main phase crystal grains can be performed in the firing step, and also can be performed in the heat treatment step. And thus, if the grain boundary phase is formed by the reaction at the outer edges of the main phase crystal grains, the thick grain boundary phase can be formed, and the main phase crystal grains with relatively small particle size are distributed at the surrounding of those with relatively big particle size. Further, the interface between the main phase crystal grains and the grain boundary phases also become smooth, and the occurrence of distortion and the like can be inhibited, and thus nucleation of reverse magnetic domains can be prevented.

As the element M promoting the reaction together with the elements R and T forming the main phase crystal grains, Al, Ga, Si, Ge, Sn, Cu and the like can be used.

According to the present invention, a rare earth based magnet with a low demagnetization rate at a high temperature can be provided, and a rare earth based magnet applicable in the motors and the like used in a high temperature environment can be provided.

DETAILED DESCRIPTION OF EMBODIMENTS

Hereinafter, the preferred embodiments of the present invention are illustrated while making a reference to the drawings. Moreover, the rare earth based magnet according to the present invention is a sintered magnet which comprises $R_2T_{14}B$ main phase crystal grains and grain boundary phases, and R contains one or more rare earth elements, T contains one or more elements of iron group including Fe as an essential element, and B is boron. Furthermore, the sintered magnet in which various well-known additive elements are further added or inevitable impurities are contained are also included.

Figure 1:
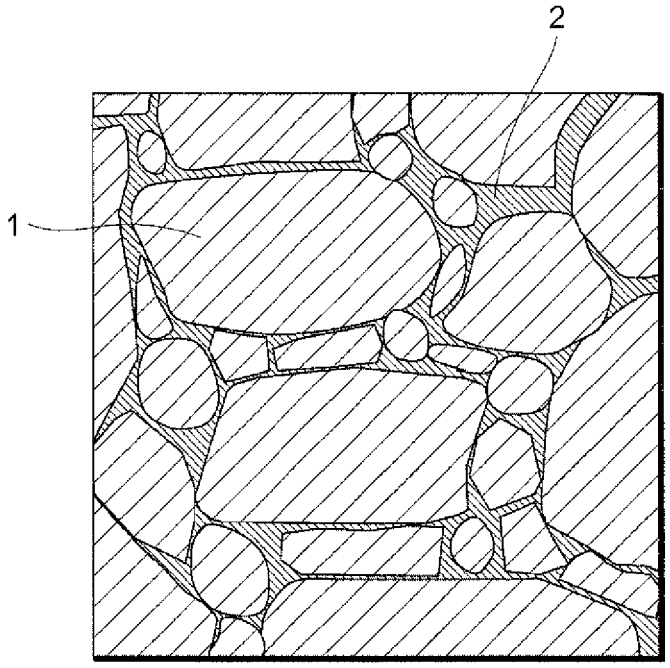
FIG. 1 is a pattern drawing showing the cross-sectional structure of the rare earth based magnet according to the present invention.

FIG. 1 is a pattern drawing showing the cross-sectional structure of the rare earth based magnet in the present embodiment according to the present invention. The rare earth based magnet according to the present embodiment comprises $R_2T_{14}B$ main phase crystal grains 1 and grain boundary phases 2 formed between adjacent $R_2T_{14}B$ main phase crystal grains 1. The magnet has the microstructure in which the main phase crystal grains with small particle size are mixed at the surrounding of those with large particle size. That is, the rare earth based magnet according to the present invention is characterized in that when evaluating the cross-sectional area distribution of the main phase crystal grains in any cross-section, the distribution is the one that respective has at least one peak at two sides of the average value of the cross-sectional area.

Firstly, the method for evaluating the particle sizes of the main phase crystal grains in the present specification and the distribution thereof are described. In the present specification, the cross-sectional area is used to represent the particle size of the main phase crystal grain. Although particle size distribution also can be formed with circle equivalent diameters converted from the cross-sectional area, the cross-sectional area is directly used in the present specification based on the following reason. That is, since decrease of surface area of the main phase crystal grains connects with the decrease of nucleation of reverse magnetic domains, it is considered that compared to the circle equivalent diameter, the area in proportion to square of the diameter is appropriate to be the indicator.

In the present specification, the number n of the main phase crystal grains whose cross-sectional area to be measured is 60 or more per each sample. Therefore, the cross-section is observed with the magnification through which about 60 crystal grains can be observed. The measurement of the cross-sectional area can be performed by image data processing based on the profile of the observed main phase crystal grains. In addition, deviation due to sampling can be avoided by sequentially, two dimensionally and continuously selecting adjacent main phase crystal grains for the n main phase crystal grains.

Once the data of n cross-sectional area is obtained, a histogram is made based on it. The interval width (rank width) of the histogram can be determined through the following procedures. Firstly, the provisional interval number (rank number) m is estimated by $m=(n)^{1/2}$. If n=60, and thus m=7.7, rounded to m=8. Next, the interval width is determined based on the value of m. The interval width is usually determined through (the maximum value−the minimum value)/m. In the present specification, the interval width w is determined based on the following formal (1).

$$w=(\text{the maximum value}-\text{the minimum value})/m \quad (1)$$

In addition, w is rounded to be the number which is easy to treat. During the determination of the interval width, the average value is used instead of the maximum value in the cross-sectional area data in order to reduce the effect of anomalous data caused by the abnormal grain growth and the like. If shown with the specific example, in the case of obtaining 60 cross-sectional area data, m=8, the average value of the cross-sectional area is 13.6 $\mu m^2$, the minimum value is 1.2 $\mu m^2$ and w=(13.6−1.2)/8=1.55, and thus w can be determined to be 2 after rounding. The frequency distribution table can be obtained by the m and w, and the histogram can be made based on it.

In the $R_2T_{14}B$ main phase crystal grains forming the rare earth based magnet according to the present embodiment, the light rare earth element, the heavy rare earth element or their combination can be taken as the rare earth based R. From the viewpoint of materials cost, R is preferably Nd, Pr or the combination thereof. The other elements are described above. The preferable range of the combination of Nd and Pr is described below.

The rare earth based magnet according to the present embodiment can contain trace amount of additive elements. The well-known elements can be used as the additive element. The additive elements are preferably those having eutectic composition with the element R as the constituent element of the $R_2T_{14}B$ main phase crystal grains. From this point, Cu and the like is preferable as the additive element and other element also can be used as the additive element. The preferable addition range of Cu is described below.

The rare earth based magnet according to the present embodiment can further contain Al, Ga, Si, Ge, Sn and the like as the element M promoting the reaction of the main phase crystal grain in the powder metallurgy process. The preferable addition amount of the element M is described below. By adding the element M besides Cu in the rare earth based magnet, the surface layer of the main phase crystal grains can be reacted and thus distortion, defects and the like can be removed, simultaneously, main phase crystal grains with relatively small particle size can be distributed and thus the two-grain boundary phase and the grain boundary multiple point can be formed thickly. Here, the two-grain boundary phase is the part wedged between the two main phase crystal grains in the boundary phase. The grain boundary multiple point is the part surrounded by three or more main phase crystal grains.

In the rare earth based magnet according to the present embodiment, the content of the above elements relative to the total mass is shown as follows.

R: 29.5~33 mass %,
B: 0.7~0.95 mass %,
M: 0.03~1.5 mass %,
Cu: 0.01~1.5 mass %, and
Fe: the balance substantially, and The total content of the elements except Fe in the elements accounting for the balance: 5 mass % or less.

R contained in the rare earth based magnet according to the present embodiment is further described in detail. Any one of Nd and Pr must be contained as R. The ratio of Nd and Pr in R can be 80~100 atomic % based on the total amount of Nd and Pr, and also can be 95~100 atomic %. The good residual flux density and coercivity can be achieved if it is at such range. Moreover, in the rare earth based magnet according to the present embodiment, the heavy rare earth elements such as Dy, Tb and the like can be contained as R. In this circumstance, the content of rare earth elements in the total mass of the rare earth based magnet is 1.0 mass % or less based on the total heavy rare earth elements, preferably 0.5 mass % or less, more preferably 0.1 mass % or less. In the rare earth based magnet according to the present embodiment, even if the content of the heavy rare earth elements is reduced like this, the good high coercivity also can be obtained, and the high temperature demagnetization rate is inhibited by making the content of other elements and atom ratio satisfy specific conditions.

The content of B is 0.7~0.95 mass % in the rare earth based magnet according to the present embodiment. The content of B is made into such specific range which is less than the stoichiometric ratio of basic composition represented with $R_2T_{14}B$, and thus combined with the additive elements, the reaction at the surface of the main phase crystal grains in the powder metallurgic process easily occurs.

The rare earth based magnet according to the present embodiment further contains trace amount of the additive elements. The well-known elements can be used as the additive element. The additive elements preferably have eutectic point with the element R as the constituent element of $R_2T_{14}B$ main phase crystal grains in the constitutional diagram. From this point, Cu and the like is preferably as the additive element. Other elements also can be taken as the additive element. As the additive amount of the element Cu, it is 0.01~1.5 mass % based on the whole. By making the additive amount within the range, the element Cu is only unevenly distributed in the grain boundary phase. On the other hand, as for the element T as the constituent element of the main phase crystal grains and the element Cu, it is thought that the combination is hard to form eutectic point since that Fe and Cu become monotectic type in the phase diagram. Here, the element M is added such that R-T-M ternary system forms eutectic point. As such the element M, for example, Al, Ga, Si, Ge, Sn and the like can be exemplified. As the content of the element M, it is 0.03~1.5 mass %. By containing the element M in such range, the reaction at the surface of the main phase crystal grains in the powder metallurgic process can be promoted, and the decrease of the particle size of the main phase crystal grains can be enhanced.

In the rare earth based magnet according to the present embodiment, as the element represented by T in the basic composition $R_2T_{14}B$, in addition to containing Fe as essential, other iron group elements can be further contained. As the other iron group elements, Co is preferable. In this case, the content of Co is preferably more than 0 mass % and 3.0 mass % or less. By containing Co within such range in the rare earth based magnet, corrosion resistance can be improved besides Curie temperature is enhanced (become higher). The content of Co can be 0.3~2.5 mass %.

The rare earth based magnet according to the present embodiment can contain C as the other element. The content of C is 0.05~0.3 mass %. If the content of C is less than the range, coercivity becomes insufficient. If the content is larger than the range, the ratio of the value of the magnetic field (Hk) when the magnetization is 90% of residual flux density, relative to coercivity, i.e., so-called square ratio (Hk/coercivity) becomes insufficient. In order to obtain better coercivity and square ratio, the content of C also can be 0.1~0.25 mass %.

The rare earth based magnet according to the present embodiment also can contain O as the other element. The content of O is 0.03~0.4 mass %. If the content of O is less than the range, the corrosion resistance of the sintered magnet is insufficient. If the content is over the range, the liquid phase cannot be sufficiently formed in the sintered magnet, and thus coercivity reduces. In order to obtain better corrosion resistance and coercivity, the content of O can be 0.05~0.3 mass %, and also can be 0.05~0.25 mass %.

In addition, in the rare earth based magnet according to the present embodiment, the content of N is preferably 0.15 mass % or less. If the content of N is more than the range, coercivity trends to be insufficient.

In addition, the content of each element falls within the range in the sintered magnet according to the present embodiment. And, when the number of atoms of the contained C, O and N are denoted as [C], [O], and [N] respectively, the relationship of $[O]/([C]+[N])<0.60$ is preferably satisfied. With such a composition, the absolute value of the high temperature demagnetization rate can be inhibited to be small.

Further, the number of atoms of the elements Nd, Pr, B, C and M in the sintered magnet of the present embodiment preferably satisfy the following relation. That is, when the number of atoms of the elements Nd, Pr, B, C and M are denoted as [Nd], [Pr], [B], [C] and [M] respectively, the relationship of $0.27<[B]/([Nd]+[Pr])<0.43$ and $0.07<([M]+[C])/[B]<0.60$ is preferably satisfied. With such a composition, high coercivity can be obtained.

Hereinafter, an example of the method for producing the rare earth based magnet according to the present embodiment is described. The rare earth based magnet according to the present embodiment may be produced by a usual powder metallurgic method comprising a preparation step of producing the raw alloys, a pulverization step of pulverizing the raw alloys to obtain raw fine powders, a molding step of molding the raw fine powders to obtain a molded body, a sintering process of firing the molded body to obtain a sintered body, and a heat treating step of subjecting the sintered body to an aging treatment.

The preparation step is the step for producing the raw alloys having the elements contained in the rare earth based magnet according to the present embodiment. Firstly, the raw metals having the specified elements are prepared, and subjected to a strip casting method and the like. The raw alloys are thus produced. As the raw metals, for examples, rare earth based metals or rare earth based alloys, pure iron, pure cobalt, ferroboron or alloys thereof are exemplified. These raw metals are used to produce the raw alloys of the rare earth based magnet having the desired composition.

The pulverization step is the step for pulverizing the raw alloys obtained in the preparation step into raw fine powders. This step is preferably performed in two stages comprising a coarse pulverization step and a fine pulverization step, and may also be performed as one stage. The coarse pulverization may be performed by using, for example, a stamp mill, a jaw crusher, a braun mill and the like under an inert gas atmosphere. A hydrogen adsorption pulverization in which pulverization is performed after adsorbing hydrogen may also be performed. In the coarse pulverization step, the raw alloys are pulverized until the particle size is around several hundred micrometers to several millimeters.

The fine pulverization step is the step in which the coarse powders obtained in the coarse pulverization step is finely pulverized to prepare the raw fine powders with the average particle size of several micrometers. The average particle size of the raw fine powders may be set under the consideration of the growth of the crystal grains after sintering. For example, the fine pulverization may be performed by a jet mill.

The molding step is a step for molding the raw fine powders in the magnetic field to produce a molded body.

Specifically, after the raw fine powders are filled into a mold equipped in an electromagnet, the molding is performed by orientating the crystallographic axis of the raw fine powders by applying a magnetic field via the electromagnet, while pressurizing the raw fine powders. The molding may be performed in a magnetic field of 1000~1600 kA/m under a pressure of about 30~300 MPa.

The sintering step is a step for firing the molded body to obtain a sintered body. After being molded in the magnetic field, the molded body may be fired in a vacuum or an inert gas atmosphere to obtain a sintered body. Preferably, the firing conditions are suitably set depending on the factors such as composition of the molded body, the pulverization method of the raw fine powders, grain size and the like. For example, the sintering may be performed at 1000° C.~1100° C. for 1~10 hours.

The heat treating step is a step for subjecting the sintered body to an aging treatment. After this step, the width of the grain boundary phases formed between the adjacent $R_2T_{14}B$ main phase crystal grains and the composition thereof are determined. However, these microstructures are not only controlled in this step, but are determined in view of the conditions of the above sintering step and the situation of the raw fine powders. Hence, the relationship between the conditions of the heat treatment and the microstructure of the sintered body may be considered to set the temperature and time period of the heat treatment. The heat treatment may be performed at a temperature ranging from 500° C. to 900° C., and may also be performed in two stages comprising a heat treatment at 800° C. nearby followed by a heat treatment at 550° C. nearby. The cooling rate during the cooling process of the heat treatment may also alter the microstructure. The cooling rate is preferably 100° C./min or more, particularly preferably 300° C./min or more. By the above aging treatment of the present invention in which the cooling rate is faster than usual, the segregation of the ferromagnetic phase in the grain boundary phase can be effectively inhibited. Thus, the causes for reducing coercivity and further deteriorating the high temperature demagnetization rate can be eliminated. By respectively setting the composition of the raw alloys, the above sintering conditions and the conditions of heat treatment, the particle size of the main phase crystal grains, i.e., the cross-sectional area distribution of the main phase crystal grains can be controlled. In the present embodiment, the method for controlling the cross-sectional area distribution of the main phase crystal grains by the conditions of heat treatment is exemplified. The rare earth based magnet of the present invention obtained by the method is not limited. By adopting the control of the composition factors and the sintering conditions, the rare earth based magnet with the same effect even under the different conditions from the heat treatment exemplified in the present embodiment can be obtained. For example, as the raw alloy powders, the two kinds of powders with different average particle sizes can be mixed and used to control the cross-sectional area distribution of the crystal grains of the sintered body.

The rare earth based magnet according to the present embodiment can be obtained by the above method. But the production method of the rare earth based magnet is not limited thereto and can be appropriately changed.

Next, the evaluation for the high temperature demagnetization rate of the rare earth based magnet according to the present embodiment is described. The shape of the sample used for evaluation is not particularly limited, and for example, it is a shape, that is generally used, with a Permeance Coefficient of 2. Firstly, residual flux of the sample at room temperature (25° C.) is measured and taken as B0. The residual flux may be measured by for example a magnetic flux meter. Next, the sample is exposed to a high temperature of 140° C. for 2 hours, and then returns to the room temperature. Once the temperature of the sample returns to the room temperature, the residual flux is measured again and taken as B1. Thus, the high temperature demagnetization rate D is evaluated by the following formula.

$$D=(B1-B0)/B0\times 100(\%)$$

The microstructure of the rare earth based magnet according to the present embodiment, i.e., the cross-sectional area distribution of the main phase crystal grains can be evaluated by using an electron microscope. The magnification can be properly set to observe 60 or more main phase crystal grains in the cross-section. The observation of the grinded cross-section of the sample after evaluating the high temperature demagnetization rate is conducted. The grinded cross-section may be parallel to the orientation axis, may perpendicular to the orientation axis, or may be any angle with the orientation axis. The specific evaluating method of the cross-sectional area distribution is shown above.

Next, the present invention is further described in detail with reference to the specific examples, but the present invention is not limited thereto.

EXAMPLES

Firstly, the raw metals of the sintered magnet were prepared. The raw alloys were respectively produced to obtain the compositions of the sintered magnets in samples No. 1~18 shown in the following Table 1 and Comparative Examples 1~2 by using these raw metals through a strip casting method. In addition, as for the content of each element shown in Table 1 and Table 3, the contents of T, R, Cu and M were measured by fluorescent X-ray analysis, and the content of B was measured by inductively-coupled plasma spectrometry. Further, the content of O was measured by an inert gas fusion-nondispersive infrared absorption method, the content of C was measured by combustion in oxygen flow-infrared absorption method, and the content of N was measured by an inert gas fusion-thermal conductivity method. In addition, [O]/([C]+[N]), [B]/([Nd]+[Pr]) and ([M]+[C])/[B] could be calculated by obtaining the number of atoms of these element from their contents obtained by these methods.

Next, after adsorption of hydrogen onto the resultant raw alloys, hydrogen pulverization by desorbing hydrogen was performed in Ar atmosphere at 600° C. for 1 hour. Then, the resultant pulverized materials were cooled to room temperature in Ar atmosphere.

After adding oleic amide as a grinding aid to the resultant pulverized materials and mixing therewith, a fine pulverization was performed by using a jet mill to obtain raw powders with an average particle size of 3.6 μm.

The resultant raw powders were molded in a low-oxygen atmosphere under the condition of an alignment magnetic field of 1200 kA/m and a molding pressure of 120 MPa to obtain a molded body.

Then, the molded body was fired in a vacuum at 1030~1050° C. for 4 hours, and quenched to obtain a sintered body. The obtained sintered body was subject to the two-stage heat treatment at 900° C. and at 500° C. The heat treatment of the first stage at 900° C. (the aging 1) was performed for an hour and the cooling rate was 100° C./min. The time period of the heat treatment and the cooling rate of the cooling process was changed in the heat treatment of the second stage at 500° C. (the aging 2). Thus, the several samples with different cross-sectional area distribution of the main phase crystal grains were prepared. In addition, the cross-sectional area distribution of the main phase crystal grains mentioned above could be changed depending on the powder properties of the raw alloy powders, the sintering condition and the like.

The residual flux density and the coercivity of the obtained samples were respectively measured by a B-H tracer. Next, the high temperature demagnetization rate was measured. These results were shown in Table 1. Subsequently, with respect to the cross-section of the samples No. and the samples of the comparative examples, whose magnetic properties were measured, the cross-section were observed through an electron microscope, and then the cross-sectional area distribution of the main phase crystal grains was measured through the method mentioned above. The evaluating results of the cross-sectional area distribution of the corresponding samples No. and the comparative examples were shown in Table 2.

In addition, the cooling rate of heat treatment at the second stage (the aging 2) was shown in Table 3. Further, the values of [O]/([C]+[N]), [B]/([Nd]+[Pr]) and ([M]+[C])/[B] in each sample was calculated when the number of atoms of the elements C, O, N, Nd, Pr, B and M contained in the sintered body were respectively taken as [C], [O], [N], [Nd], [Pr], [B] and [M], and the values were shown in Table 3. The amount of oxygen and the amount of nitrogen contained in the rare earth based magnet were adjusted to the ranges shown in Table 3 by controlling the atmospheres from the pulverization step to the heat treating step, especially adjusting the amount of oxygen and the amount of nitrogen contained in the atmosphere in the pulverization step. Moreover, the amount of carbon contained in the raw materials of the rare earth based magnet was adjusted to the range shown in Table 3 by adjusting the amount of the grinding aid added in the pulverization step.

TABLE 1

| | The composition of the sintered magnet (mass %) | | | | | | | | | | | |
|---|---|---|---|---|---|---|---|---|---|---|---|---|
| | R | | | | | | M | | | | | |
| Sample No. | Total | Nd | Pr | Dy | B | Cu | Al | Ga | Si | Ge | Sn | Fe |
| Sample No. 1 | 33.0 | 33.0 | 0.0 | 0.0 | 0.70 | 0.7 | 0.2 | 1.3 | 0.0 | 0.0 | 0.0 | bal. |
| Sample No. 2 | 33.0 | 33.0 | 0.0 | 0.0 | 0.70 | 0.7 | 0.2 | 1.3 | 0.0 | 0.0 | 0.0 | bal. |
| Sample No. 3 | 32.5 | 32.5 | 0.0 | 0.0 | 0.80 | 0.4 | 0.2 | 0.7 | 0.0 | 0.0 | 0.0 | bal. |
| Sample No. 4 | 32.5 | 32.5 | 0.0 | 0.0 | 0.80 | 0.4 | 0.2 | 0.7 | 0.0 | 0.0 | 0.0 | bal. |
| Sample No. 5 | 32.0 | 32.0 | 0.0 | 0.0 | 0.83 | 0.1 | 0.2 | 0.5 | 0.0 | 0.0 | 0.0 | bal. |
| Sample No. 6 | 32.0 | 32.0 | 0.0 | 0.0 | 0.83 | 0.1 | 0.2 | 0.5 | 0.0 | 0.0 | 0.0 | bal. |
| Sample No. 7 | 32.0 | 32.0 | 0.0 | 0.0 | 0.83 | 0.1 | 0.2 | 0.5 | 0.0 | 0.0 | 0.0 | bal. |
| Sample No. 8 | 32.0 | 32.0 | 0.0 | 0.0 | 0.83 | 0.1 | 0.2 | 0.5 | 0.0 | 0.0 | 0.0 | bal. |
| Sample No. 9 | 32.0 | 32.0 | 0.0 | 0.0 | 0.83 | 0.1 | 0.2 | 0.0 | 0.3 | 0.0 | 0.0 | bal. |
| Sample No. 10 | 32.0 | 32.0 | 0.0 | 0.0 | 0.83 | 0.1 | 0.2 | 0.0 | 0.0 | 0.3 | 0.0 | bal. |
| Sample No. 11 | 32.0 | 32.0 | 0.0 | 0.0 | 0.83 | 0.1 | 0.2 | 0.0 | 0.0 | 0.0 | 0.3 | bal. |
| Sample No. 12 | 32.0 | 32.0 | 0.0 | 0.0 | 0.83 | 0.1 | 0.5 | 0.0 | 0.0 | 0.0 | 0.0 | bal. |
| Sample No. 13 | 31.5 | 31.5 | 0.0 | 0.0 | 0.87 | 0.1 | 0.2 | 0.3 | 0.0 | 0.0 | 0.0 | bal. |
| Sample No. 14 | 31.5 | 31.5 | 0.0 | 0.0 | 0.92 | 0.1 | 0.2 | 0.2 | 0.0 | 0.0 | 0.0 | bal. |
| Sample No. 15 | 31.0 | 31.0 | 0.0 | 0.0 | 0.95 | 0.1 | 0.2 | 0.2 | 0.0 | 0.0 | 0.0 | bal. |
| Sample No. 16 | 30.5 | 30.5 | 0.0 | 0.0 | 0.95 | 0.1 | 0.2 | 0.0 | 0.0 | 0.0 | 0.0 | bal. |
| Sample No. 17 | 32.0 | 25.0 | 7.0 | 0.0 | 0.83 | 0.1 | 0.2 | 0.5 | 0.0 | 0.0 | 0.0 | bal. |
| Sample No. 18 | 32.0 | 31.0 | 0.0 | 1.0 | 0.83 | 0.1 | 0.2 | 0.5 | 0.0 | 0.0 | 0.0 | bal. |
| Comparative Example 1 | 30.0 | 30.0 | 0.0 | 0.0 | 1.00 | 0.5 | 0.2 | 0.0 | 0.0 | 0.0 | 0.0 | bal. |
| Comparative Example 2 | 30.5 | 22.0 | 6.5 | 2.0 | 1.00 | 0.5 | 0.2 | 0.0 | 0.0 | 0.0 | 0.0 | bal. |

| | | | | | | | Magnetic properties | | |
|---|---|---|---|---|---|---|---|---|---|
| | Firing | | Aging 1 | | Aging 2 | | | | |
| Sample No. | Temperature ° C. | Time period hr | Temperature ° C. | Time period hr | Temperature ° C. | Time period hr | Br kG | Hcj kOe | High temperature demagnetization rate % |
| Sample No. 1 | 1030 | 4 | 900 | 1 | 500 | 20 | 13.3 | 26.0 | −0.2 |
| Sample No. 2 | 1030 | 4 | 900 | 1 | 500 | 1 | 13.3 | 25.0 | −0.2 |
| Sample No. 3 | 1030 | 4 | 900 | 1 | 500 | 20 | 13.5 | 24.0 | −0.3 |
| Sample No. 4 | 1030 | 4 | 900 | 1 | 500 | 1 | 13.5 | 23.0 | −0.3 |
| Sample No. 5 | 1030 | 4 | 900 | 1 | 500 | 20 | 13.7 | 23.0 | −0.3 |
| Sample No. 6 | 1030 | 4 | 900 | 1 | 500 | 10 | 13.7 | 22.5 | −0.4 |
| Sample No. 7 | 1030 | 4 | 900 | 1 | 500 | 5 | 13.7 | 22.0 | −0.4 |
| Sample No. 8 | 1030 | 4 | 900 | 1 | 500 | 1 | 13.7 | 21.7 | −0.3 |
| Sample No. 9 | 1030 | 4 | 900 | 1 | 500 | 1 | 13.7 | 19.5 | −0.9 |
| Sample No. 10 | 1030 | 4 | 900 | 1 | 500 | 1 | 13.7 | 19.2 | −1.0 |
| Sample No. 11 | 1030 | 4 | 900 | 1 | 500 | 1 | 13.7 | 19.4 | −0.8 |
| Sample No. 12 | 1030 | 4 | 900 | 1 | 500 | 1 | 13.6 | 19.8 | −0.7 |
| Sample No. 13 | 1030 | 4 | 900 | 1 | 500 | 1 | 13.8 | 20.0 | −0.7 |
| Sample No. 14 | 1030 | 4 | 900 | 1 | 500 | 1 | 13.9 | 19.0 | −1.2 |

TABLE 1-continued

| | | | | | | | | | |
|---|---|---|---|---|---|---|---|---|---|
| Sample No. 15 | 1050 | 4 | 900 | 1 | 500 | 1 | 14.0 | 18.0 | −1.5 |
| Sample No. 16 | 1050 | 4 | 900 | 1 | 500 | 1 | 14.1 | 17.0 | −1.8 |
| Sample No. 17 | 1030 | 4 | 900 | 1 | 500 | 1 | 13.7 | 21.7 | −0.3 |
| Sample No. 18 | 1030 | 4 | 900 | 1 | 500 | 1 | 13.5 | 24.0 | −0.3 |
| Comparative Example 1 | 1050 | 4 | 900 | 1 | 500 | 1 | 14.2 | 15.0 | −8.0 |
| Comparative Example 2 | 1050 | 4 | 900 | 1 | 500 | 1 | 13.8 | 16.0 | −4.0 |

TABLE 2

| Sample No. | The shape of the distribution | Width of the first peak | The convex shape corresponding to the first peak after smoothing treatment |
|---|---|---|---|
| Sample No. 1 | There were peaks at the two sides of the average value. | 5.5 | There was a protrusion at the shoulder (right side). |
| Sample No. 2 | There were peaks at the two sides of the average value. | 5.5 | There was a protrusion at the shoulder (right side). |
| Sample No. 3 | There were peaks at the two sides of the average value. | 6.0 | There was a protrusion at the shoulder (right side). |
| Sample No. 4 | There were peaks at the two sides of the average value. | 6.0 | There was a protrusion at the shoulder (right side). |
| Sample No. 5 | There were peaks at the two sides of the average value. | 6.0 | There was a protrusion at the shoulder (right side). |
| Sample No. 6 | There were peaks at the two sides of the average value. | 6.0 | There was a protrusion at the shoulder (right side). |
| Sample No. 7 | There were peaks at the two sides of the average value. | 5.5 | There was a protrusion at the shoulder (right side). |
| Sample No. 8 | There were peaks at the two sides of the average value. | 5.5 | There was a protrusion at the shoulder (right side). |
| Sample No. 9 | There were peaks at the two sides of the average value. | 6.0 | There was a protrusion at the shoulder (right side). |
| Sample No. 10 | There were peaks at the two sides of the average value. | 5.5 | There was a protrusion at the shoulder (right side). |
| Sample No. 11 | There were peaks at the two sides of the average value. | 5.0 | There was a protrusion at the shoulder (right side). |
| Sample No. 12 | There were peaks at the two sides of the average value. | 5.5 | There was a protrusion at the shoulder (right side). |
| Sample No. 13 | There were peaks at the two sides of the average value. | 5.5 | There was a protrusion at the shoulder (right side). |
| Sample No. 14 | There were peaks at the two sides of the average value. | 5.0 | There was a protrusion at the shoulder (right side). |
| Sample No. 15 | There were peaks at the two sides of the average value. | 5.0 | There was a protrusion at the shoulder (right side). |
| Sample No. 16 | There were peaks at the two sides of the average value. | 5.0 | There was a protrusion at the shoulder (right side). |
| Sample No. 17 | There were peaks at the two sides of the average value. | 5.5 | There was a protrusion at the shoulder (right side). |
| Sample No. 18 | There were peaks at the two sides of the average value. | 6.0 | There was a protrusion at the shoulder (right side). |
| Comparative Example 1 | There was peak at the downside of the average value. | 3.5 | Monotone decreasing. |
| Comparative Example 2 | There was peak at the downside of the average value. | 4.0 | There was a flat region at the shoulder (right side). |

TABLE 3

| | The contents of N, C and O contained in the sintered magnet | | | Cooling rate of the aging | | | |
|---|---|---|---|---|---|---|---|
| | N | C | O | 2 | The ratio of the number of atoms | | |
| Sample No. | mass % | mass % | mass % | ° C./min | [B]/([Nd] + [Pr]) | ([M] + [C]/[B]) | [O]/([C] + [N]) |
| Sample No. 1 | 0.05 | 0.15 | 0.10 | 600 | 0.28 | 0.59 | 0.39 |
| Sample No. 2 | 0.05 | 0.15 | 0.09 | 600 | 0.28 | 0.59 | 0.35 |
| Sample No. 3 | 0.04 | 0.14 | 0.09 | 300 | 0.33 | 0.39 | 0.39 |

TABLE 3-continued

| | The contents of N, C and O contained in the sintered magnet | | | Cooling rate of the aging | The ratio of the number of atoms | | |
|---|---|---|---|---|---|---|---|
| | N | C | O | 2 | | | |
| Sample No. | mass % | mass % | mass % | ° C./min | [B]/([Nd] + [Pr]) | ([M] + [C]/[B]) | [O]/([C] + [N]) |
| Sample No. 4 | 0.04 | 0.13 | 0.08 | 300 | 0.33 | 0.38 | 0.37 |
| Sample No. 5 | 0.04 | 0.14 | 0.09 | 600 | 0.35 | 0.34 | 0.39 |
| Sample No. 6 | 0.05 | 0.13 | 0.08 | 600 | 0.35 | 0.33 | 0.35 |
| Sample No. 7 | 0.04 | 0.13 | 0.07 | 600 | 0.35 | 0.33 | 0.32 |
| Sample No. 8 | 0.04 | 0.14 | 0.06 | 600 | 0.35 | 0.34 | 0.26 |
| Sample No. 9 | 0.04 | 0.10 | 0.09 | 100 | 0.35 | 0.34 | 0.51 |
| Sample No. 10 | 0.06 | 0.10 | 0.09 | 100 | 0.35 | 0.26 | 0.45 |
| Sample No. 11 | 0.05 | 0.11 | 0.09 | 100 | 0.35 | 0.25 | 0.44 |
| Sample No. 12 | 0.04 | 0.12 | 0.09 | 100 | 0.35 | 0.37 | 0.44 |
| Sample No. 13 | 0.04 | 0.10 | 0.08 | 300 | 0.37 | 0.25 | 0.45 |
| Sample No. 14 | 0.04 | 0.09 | 0.09 | 550 | 0.39 | 0.21 | 0.55 |
| Sample No. 15 | 0.05 | 0.09 | 0.09 | 300 | 0.41 | 0.20 | 0.51 |
| Sample No. 16 | 0.04 | 0.10 | 0.10 | 400 | 0.42 | 0.18 | 0.56 |
| Sample No. 17 | 0.04 | 0.09 | 0.06 | 600 | 0.34 | 0.29 | 0.36 |
| Sample No. 18 | 0.04 | 0.09 | 0.06 | 600 | 0.36 | 0.29 | 0.36 |
| Comparative Example 1 | 0.04 | 0.09 | 0.12 | 40 | 0.44 | 0.16 | 0.73 |
| Comparative Example 2 | 0.04 | 0.10 | 0.11 | 60 | 0.47 | 0.17 | 0.62 |

It could be seen from Table 1 that the high temperature demagnetization rate was inhibited to be −2% or less even when the rare earth based magnet was adopted under high temperature in samples No. 1~18. In Comparative Examples 1 and 2, the high temperature demagnetization rate was −4% or more, and thus the effect of inhibiting the high temperature demagnetization was not brought out. The effect of inhibiting the high temperature demagnetization in the samples No. 1~18 was realized by setting the cross-sectional area distribution of the main phase crystal grains in the cross-section of the sintered magnet to be the specific structure according to the present invention. Based on FIGS. 2(*a*), 2(*b*), FIGS. 3(*a*), 3(*b*) and Table 2, it was described as follows.

Figure 2:
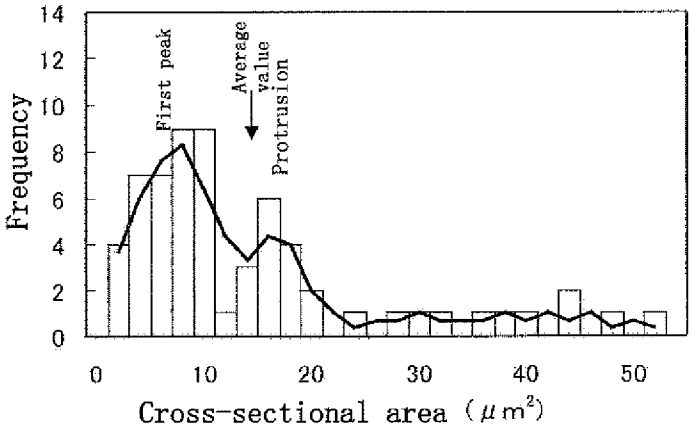
FIGS. 2(*a*) and 2(*b*) are drawings showing the cross-sectional structure of Sample No. 8 in the present embodiment, FIG. 2(*a*) is an electron microscope photograph of the cross-section of the rare earth based magnet, and FIG. 2(*b*) is a graph showing the cross-sectional area distribution measured by the cross-section of the main phase crystal grains.
Figure 2:
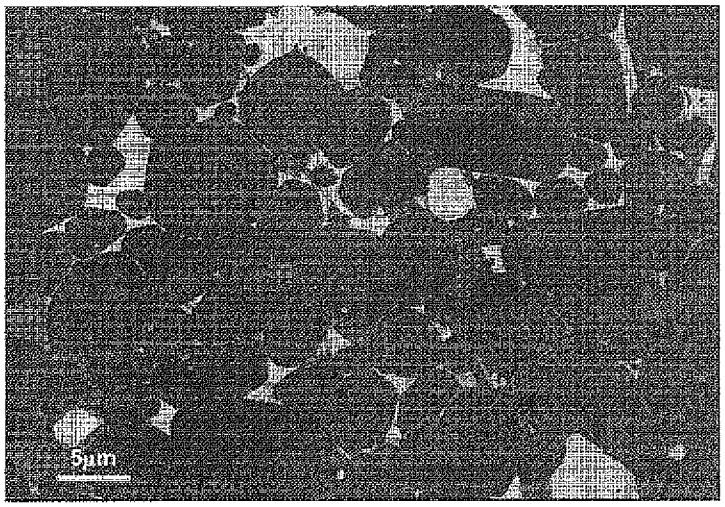

FIGS. 2(*a*) and 2(*b*) showed the cross-section of sample No. 8. FIG. 2(*a*) was an electron microscope photograph of the observed cross-section, and FIG. 2(*b*) showed the cross-sectional area distribution of the main phase crystal grains measured based on the cross-sectional observation. The histogram shown in FIG. 2(*b*) was made by the above method. The line graph shown together with the histogram was obtained by smoothing treatment of frequency distribution. The smoothing treatment was the three-point moving average method, i.e., the method in which the average value of total three data that the target data and the anteroposterior data were regarded as the data of the target point. It was considered that by the smoothing treatment, even when the cross-sectional area distribution was evaluated with the histogram, the effect of accidentally appeared peak due to dividing the interval also could be reduced. The position indicated by arrows in FIG. 2(*b*) showed the average value of the the specification was set based on the average value of the cross-sectional area. It could be known from FIG. 2(*b*) that the peak was formed at the two side of the average value of the cross-sectional area in the histogram showing the cross-sectional area distribution. The peak in the histogram showing the cross-sectional area distribution in the specification referred to the same meaning as above. Among the peaks, the peak at the side with the value smaller than the average value was called the first peak as described above. In FIG. 2(*b*), the peak with the width of 5.5 intervals existed at the side with the value smaller than the average value. And, the peak with the width of 4.5 intervals existed at the side with the value larger than the average value. When the interval in which the frequency was extremely low was shared by the adjacent peak, the interval was calculated as 0.5 interval. The same evaluation of the cross-sectional area distribution was conducted for the sample No. 1~18 in Examples. As a result, it was confirmed in Table 2 that one or more peaks were formed at the two sides (the side with smaller value and the side with larger value) of the average value. The results were shown in the 'shape of the distribution' of Table 2.

Figure 4:
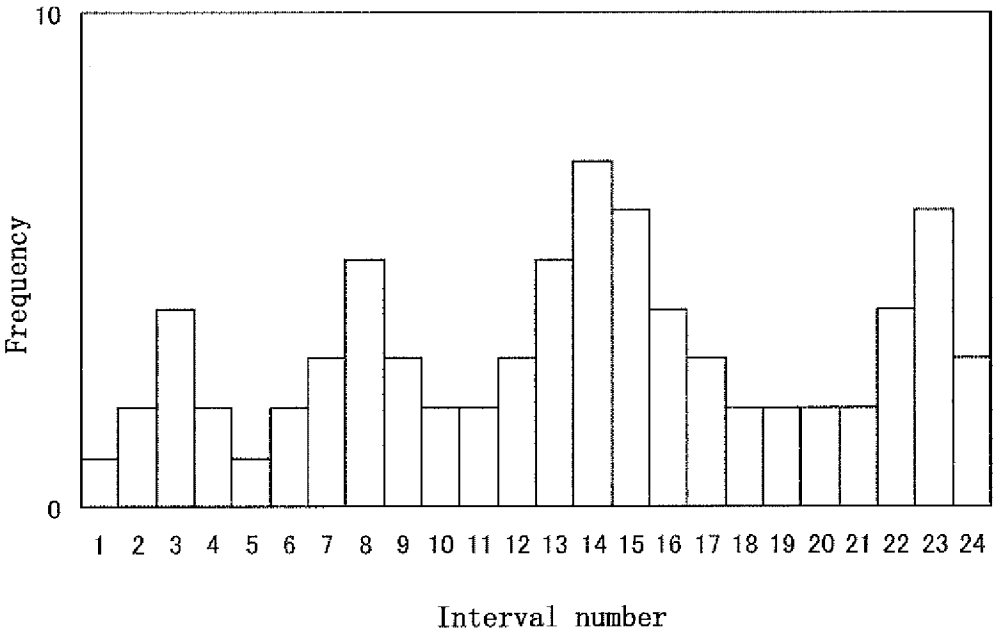
FIG. 4 is a drawing illustrating the method for calculating the width of the peaks in the histogram in the present Examples.

Here, the method for calculating the interval width of the peak in the histogram in the specification was described in detail based on FIG. 4. FIG. 4 was a pattern drawing showing the histogram with multiple peaks. The interval numbers 1, 5, 10~11 and 18~20 were respectively those in which the frequency was minimum value. Although a peak was formed in the interval number 1~5, the interval number 5 among them was the minimum interval of the next peak (the interval number 5~10) thus shared by the two peaks. In such case, among the peaks in the interval numbers 1~5, the interval number 5 was calculated as 0.5 interval, and the width of the peak was calculated as 4.5 intervals. The next peak was formed in the interval numbers 5~10, the interval number 5 was calculated as 0.5 based on the above reason. As for the interval number 10, since the frequency of the next interval number 11 also was the minimum value, the case that the interval was not shared with the adjacent peak was calculated as 1.0. Hence, the width of the peaks formed in the interval numbers 5~10 was calculated as 5.5 intervals. If the peaks appeared in the interval number 11 or more were observed, the interval numbers 18~21 became minimum value with the same frequency. In such case, only the interval which was closest to the peak among the intervals with the minimum value is considered belonged to the peak. Therefore, the peak of this part appeared in the interval numbers 11~18, and its width was calculated as 8.0 intervals.

The smoothing treatment of the cross-sectional distribution mentioned above was performed in order to avoid accidentally appeared peak due to dividing the interval. The line graph shown in FIG. 2(*b*) is a graph showing the cross-sectional area distribution after smoothing treatment. In the histogram showing the cross-sectional area distribution, when the peaks were at two sides of the average value, by performing the smoothing treatment, it could be confirmed that the line graph had the part with convex upward shape corresponding to the first peak in the histogram showing the above cross-sectional area distribution, and the protrusion corresponding to the peak formed at the side with larger value than the average value of cross-sectional area in the histogram showing the cross-sectional area distribution, was formed at the shoulder of the side with larger cross-sectional area of the part becoming convex upward shape. The results whether the protrusion was formed after smoothing treatment or not were shown in the column 'the first peak after smoothing treatment or not were shown in the column 'the first peak after smoothing treatment' of Table 2.

Figure 3B:
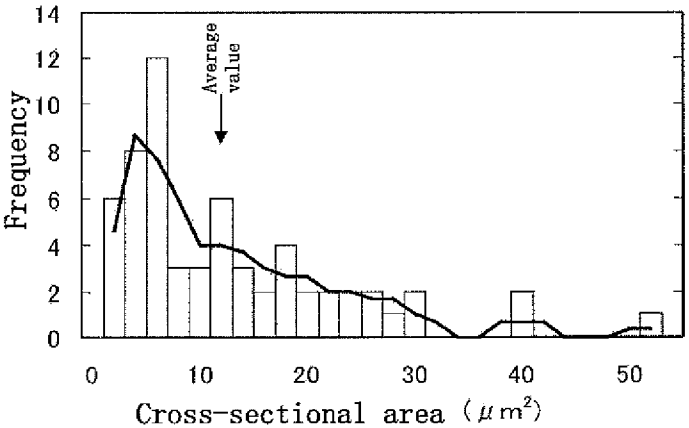
FIGS. 3(*a*) and 3(*b*) are drawings showing the cross-sectional structure in Comparative Example 2, FIG. 3(*a*) is an electron microscope photograph of the cross-section of the rare earth based magnet, and FIG. 3(*b*) is a graph showing the cross-sectional area distribution measured by the cross-section of the main phase crystal grains.
Figure 3:
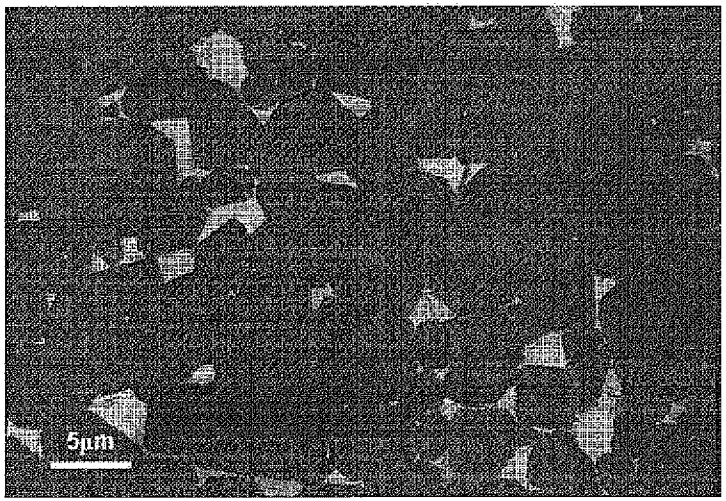

FIGS. 3(*a*) and 3(*b*) showed the cross-section of Comparative Example 2. FIG. 3(*a*) was an electron microscope photograph of the observed cross-section, and FIG. 3(*b*) showed the cross-sectional area distribution of the measured main phase crystal grains based on the cross-sectional observation. The method for making the histogram and the method for smoothing treatment were the same as mentioned above. The arrow in FIG. 3(*b*) showed the position of the average value of the cross-sectional area of the main phase crystal grains. It could be known from FIG. 3(*b*) that the peaks at two sides of the average value were also formed in Comparative Example 3. However, the width of the part which was like peak at the side with larger value than the average value was 4 intervals or less calculated based on the interval width of the histogram. Further, the width of the part with higher frequency than the minimum value at the smaller cross-sectional area side of the peak was calculated as only 1 interval. In the present specification, it is not considered as a peak in such case as mentioned above. As shown in the line graph of FIG. 3(*b*), even the smoothing treatment was conducted for such frequency distribution, the significant protrusion was not formed at the right side (at the side with larger cross-sectional area) of the first peak in the histogram showing the cross-sectional area distribution. Though the flat region was formed, the high temperature demagnetization rate was insufficient in such distribution shape.

In the 'the width of the first peak' of FIGS. 2(*a*) and 2(*b*), the interval width was used as a unit to show the width of the peak (the width of the first peak) at the side with As mentioned above, since the interval width was set based on the average value of the cross-sectional area of the main phase crystal grains, the width of the peak was taken as the indicator showing the distribution of the small grains on the basis of the average value. By making the width of the first peak to be 5.5 intervals or more based on the interval width of the histogram, the microstructure in which the small grains were properly filled at the surrounding of the large grains could be formed, and small grains were mixed at the surrounding of the large grains. As a result, the rare earth based magnet composed of the main phase crystal grains whose magnetic coupling with each other was cut was obtained.

It could be seen from Table 2 that the significant peak, i.e., the peak referred in the present specification, was not formed at the side with the value larger than the average value in the cross-sectional area distribution of the main phase crystal grains in Comparative Examples 1 and 2. With respect to the main phase crystal grains with large particle size and having the larger cross-sectional area than the average value, it was shown that the crystal grain size was widely distributed, but the crystal grains with about specific size were not existed. Additionally, as shown in Table 2, the width of the first peak was 4.0 interval or less in these comparative examples. It was indicated that the particle size distribution in which small crystal grains surrounded the large ones was extremely sharp compared to the distribution width of the large crystal grains. Therefore, in such distribution of the crystal grains, large crystal grains could not be surrounded by small ones, and the grain boundary phase with broad width was also hard to be formed, thus the effect of magnetically isolation between the main phase crystal grains was not brought out.

In addition, as shown in FIGS. 3(*a*) and 3(*b*), in the samples No. 1~18 that meet the conditions of the present invention, the microstructure was formed in the sintered magnet and the number of atoms of the elements Nd, Pr, B, C and M contained in the sintered magnet satisfied the specific relation as follows. That is, when the number of atoms of the elements Nd, Pr, B, C and M were denoted as [Nd], [Pr], [B], [C] and [M] respectively, the relations of $0.27<[B]/([Nd]+[Pr])<0.43$ and $0.07<([M]+[C])/[B]<0.60$ were satisfied. Thus, when $0.27<[B]/([Nd]+[Pr])<0.43$ and $0.07<([M]+[C])/[B]<0.60$, the coercivity(Hcj) could be effectively improved.

Moreover, as shown in FIGS. 3(*a*) and 3(*b*), in the samples No. 1~18 that meet the conditions of the present invention, the microstructure was formed in the sintered magnet and the number of atoms of O, C and N contained in the sintered magnet satisfied the specific relation as follows. That is, when the number of atoms of O, C and N were denoted as [O], [C], and [N] respectively, the relation of $[O]/([C]+[N])<0.60$ was satisfied. Thus, when $[O]/([C]+[N])<0.60$, the high temperature demagnetization rate D can be effectively inhibited.

The present invention was described with reference to the embodiments above. The embodiments were exemplified, and various modification and changes may be included within the claims of the present invention. In addition, one skilled in the art will understand that the modified examples and changes are within the claims of the present invention. Thus, the description and the drawings in the present specification should be considered as illustrative but not limited.

According to the present invention, it is possible to provide a rare earth based magnet that is applicable even at a high temperature environment.

DESCRIPTION OF REFERENCE NUMERALS

1 Main phase crystal grains
2 Grain boundary phase

What is claimed is:

1. A rare earth based magnet, wherein, the rare earth based magnet is a sintered magnet which comprises $R_2T_{14}B$ crystal grains as the main phase and grain boundary phases between $R_2T_{14}B$ crystal grains, R represents one or more rare earth elements, T represents Fe and optionally one or more other elements of iron group, and B is boron, the magnet having a property that a cross-sectional area distribution of the main phase crystal grains that is evaluated by histogram in any cross-section of the rare earth based magnet, the cross-sectional area distribution is the one that respectively has at least one peak at two sides of the average value of the cross-sectional area of the main crystal grains, the rare earth based magnet includes M and Cu, M represents Ga and optionally one or more elements of Al, Si, Ge and Sn, the content of R, B, M, Cu and Fe relative to the total mass of the rare earth based magnet is shown as follows:

R: about 29.5-33 mass %,

B: 0.7-0.83 mass %,

M: about 0.2-1.5 mass %,

Cu: about 0.01-1.5 mass %, and

Fe: the balance substantially, and the total content of the elements except Fe in the elements accounting for the balance: 5 mass % or less, the content of heavy rare earth elements among R is 1.0 mass % or less, including 0 mass %, the content of Ga is 0.2-1.3 mass %, the rare earth based magnet includes C, N and O as the elements accounting for the balance, and the content of C is about 0.05-0.3 mass %, the content of 0 is about 0.03-0.4 mass %, and the content of N is about 0.15 mass % or less, wherein the absolute value of the high temperature demagnetization rate is 0.4% or less.

2. The rare earth based magnet according to claim 1, wherein, in said histogram showing said cross-sectional area distribution of the main phase crystal grains, the peak having the highest frequency among the peaks appeared in the side with smaller value than the average value of the cross-sectional area is regarded as the first peak, and the width of the first peak calculated based on the interval width of the histogram is 5.5 intervals or more.

3. The rare earth based magnet according to claim 1, wherein, said histogram showing said cross-sectional area distribution of the main phase crystal grains is made into a line graph through smoothing treatment, the line graph has a part with convex upward shape corresponding to the peak having the highest frequency among the peaks appeared in the side with smaller value than the average value of the cross-sectional area, and a protrusion is contained at the shoulder of the side with larger cross-sectional area of the part becoming convex upward shape.

4. The rare earth based magnet according to claim 2, wherein, said histogram showing said cross-sectional area distribution of the main phase crystal grains is made into a line graph through smoothing treatment, the line graph has a part with convex upward shape corresponding to said first peak, and a protrusion is contained at the shoulder of the side with larger cross-sectional area of the part becoming convex upward shape.

5. The rare earth based magnet according to claim 1, wherein, the content of heavy rare earth elements among R is 0 mass %.

* * * * *